US005109780A

United States Patent [19]

Slouf et al.

[11] Patent Number: 5,109,780

[45] Date of Patent: May 5, 1992

[54] EMBROIDERY TOOL

[76] Inventors: James W. Slouf; Elizabeth J. Slouf, both of 186 Tropicana Dr., Punta Gorda, Fla. 33950

[21] Appl. No.: 729,574

[22] Filed: Jul. 15, 1991

[51] Int. Cl.[5] ..... D05C 15/06

[52] U.S. Cl. ..... 112/80.03; 112/169

[58] Field of Search ..... 112/80.03, 80.04, 80.05, 112/80.06, 169; 66/115, 116, 117, 118; 223/102, 104; 604/224

[56] References Cited

U.S. PATENT DOCUMENTS

| | | | |
|---|---|---|---|
| 512,911 | 1/1894 | Shogren | 112/80.03 X |
| 662,748 | 11/1900 | Wood | 112/80.03 X |
| 1,878,889 | 9/1932 | Roberts | 112/80.05 |
| 2,097,380 | 10/1937 | Morgan | 112/80.05 |
| 2,610,598 | 9/1952 | Midas | 112/80.05 |
| 3,938,452 | 2/1976 | Windle | 112/80.06 |
| 4,306,510 | 12/1981 | O'Brien | 112/80.05 |
| 4,479,445 | 10/1984 | Walker | 112/80.05 |
| 4,886,003 | 12/1989 | Walker | 112/80.03 |

*Primary Examiner*—Werner H. Schroeder
*Assistant Examiner*—Paul C. Lewis
*Attorney, Agent, or Firm*—Frank A. Lukasik

[57] ABSTRACT

An embroidering tool comprising a barrel serving as an outer shell with a slot having notches for receiving a pin located on the outer surface of a shaft inserted into the bore. An interchangeable tip having a cannular needle pressed therein is inserted into an axial bore within the shaft and locked therein. The shaft is then assembled with a spring and inserted into the bore of the barrel with the pin moved along the slot until it is engaged within the proper slot setting. The invention provides an embroidery tool in which the mechanism for adjusting the exposed length of the needle is extremely durable, simple, easy to manipulate, and rapid and consistently precise.

4 Claims, 2 Drawing Sheets

EMBROIDERY TOOL

BACKGROUND OF THE INVENTION

1. Field of the Invention

The invention relates generally to punch embroidery and more specifically to punch embroidery using iron-on transfers to provide patterns to punch inside of a garment or the back of fabric.

2. Background of the Prior Art

Punch embroidery tools of the type described herein have a tubular needle which is mounted at one end of a finger manipulatable holder. The holder has a passage which communicates with the proximal end of the needle so as to accommodate movement of a length of yarn through the holder and into the needle passage or hollow during use of the tool. The distal end of the needle is equipped with a lateral opening eye that communicates with the needle passage and here the yarn length is threaded through the eye and passes from the needle passage to the exterior of the needle during use of the tool.

In practice, the distal end of the needle is inserted in the back side of the basic fabric and from where it passes to a point offset from the front side of the fabric before being withdrawn. Upon initial penetration of the basic fabric, the yarn at the exterior of the needle eye is frictionally engaged by the basic fabric material. As the needle is passed further through the fabric, the yarn length is pulled downwardly through the handle passage and needle passage until such time as the full hilt of the needle insertion is realized. Thereafter, as the needle length is withdrawn, a loop is formed at the front side of the basic fabric. As the eye containing distal end portion of the needle is withdrawn from the fabric, the fabric material closes in about the yarn at the opposite ends of the length portion of the yarn forming the loop so that the loop is thereafter maintained and frictionally held in place by the fabric material that surrounded the needle at the point of insertion and withdrawal. In practice, the insertion and withdrawal procedure is repeated with each point of insertion in the basic fabric being, in most cases, in an area which is proximate to the point of the previous withdrawal of the needle from the basic fabric.

U.S. Pat. No. 1,878,889 to Roberts, U.S. Pat. No. 2,610,598 to Midas, U.S. Pat. No. 3,938,452 to Windle, U.S. Pat. No. 4,306,510 to O'Brien, U.S. Pat. No. 4,479,445 to Walker, and U.S. Pat. No. 4,886,003 to Walker show typical prior art embroidering tools that employ a hollow needle through which the yarn is drawn during use and further illustrate the procedures involved in the use of such tools.

As shown in the prior art, the size of the loop formed at the front side of the basic fabric is determined by the depth of penetration of the needle during use. This is normally determined in those embroidering tools that have a needle and holder which are relatively fixed by the location of the needle eye with respect to the adjacent end extremity of the holder. The adjacent end of the holder in such cases serves as a stop that engages the back side of the fabric and serves to limit the depth of needle penetration and thus the size of the loop formed during use. To shorten the depth of penetration and thus provide an element of variance in the sizes of the loops formed by such tools, small sleeve elements that fit over the needle are frequently provided by the tool manufacturers. These sleeve elements are of different lengths and to decrease the depth of penetration, an appropriate sleeve length is selected for placement on the needle in abutting relation to the adjacent end extremity of the holder. The sleeve tightly fits on the needle and during use, the end of the sleeve which is offset from the end extremity of the holder serves to stop the advancement of the needle into the basic fabric to determine the depth of penetration and thus the size of loop formation.

In some types of embroidering tools of the hollow needle type, provisions are made for adjusting the location of the needle along the axis of the holder so that in effect a means is provided for adjusting the distance between the stop forming end extremity of the needle holder and the eye at the distal end of the needle. The O'Brien patent is illustrative of embroidering tools that are provided with adjustable needle capabilities. U.S. Pat. No. 4,479,445 to Walker is formed entirely of plastic, except for the needle which is formed of steel and closely resembles a hypodermic needle in that it has a bore extending through the length thereof and with the sharp end of the needle having an eye formed therethrough with one end of the bore terminating openly in the inner perimeter of the eye of the needle. The thread or yarn employed in punch embroidery extends from the spool of thread through the bore of the needle and then through the eye of the needle. Walker comprises a first elongated, generally cylindrically shaped plastic element with a bore formed therethrough. A portion of the outer surface is threaded. A second elongated cylindrically shaped plastic element has a bore therethrough and has a protruding button on the surface of the bore. Such button fits within the threads of the first elongated element and functions as a matching thread with the threaded portion of the first elongated plastic element. Thus, as the second element is rotated with respect to the first element, such second element will move longitudinally with respect to the first element.

One of the principal problems encountered with the above-described Walker prior art punch embroidery needle assembly lies in the use of the protruding button on the surface of the bore extending through the second element. Because the button is relatively small and made of plastic it is fragile and relatively soft and tends to wear off with usage, thereby destroying its function as a threaded surface of the second element with respect to the first element. The exposed length of the needle, therefore, cannot either be accurately controlled or even maintained in a fixed position since the second element can now simply slide axially with respect to the first element and will not be controllable by a relative rotational movement of the second element with respect to the first element.

A further difficulty commonly experienced with punch embroidery type needles of the type described in the Walker patent or other prior art devices, is that the needle frequently bends because of the force applied thereto by the user so that the needle occasionally must be replaced. With the Walker tool, a bent needle requires not only the replacement of the needle but also the replacement of the first plastic element within which the needle is firmly and permanently secured. To replace only the needle and the first plastic element in which the needle is held is tantamount to replacing the entire structure because by the time the needle becomes bent it is quite likely that the small plastic button which acts as a thread in the bore of the second element will probably be well worn down and should also be replaced. Replacement of a prior art punch embroidery needle of the type described above costs over ten dollars retail at the filing date hereof.

In U.S. Pat. No. 4,886,003, Walker attempted to improve the art by providing a punch embroidery tool in which a damaged needle can be replaced without replacing any other portion of the device. Walker's solution was to provide an all metal punch embroidery needle which consists of four major parts screwed together by conventional threaded portions. The threaded bore portion of the needle hub screws onto the threaded, narrowed diameter of the elongated element which is also threaded on its larger diameter external portion. To change the needle exposure a first element is unscrewed from a second element to unlock the two elements from each other. Then, both elements can be moved in either direction on a third element by hand turning knurled portions a distance equal to the distance that the needle exposure is to be lengthened or shortened while holding the third element in place. The second element is then screwed back onto the first element until it abuts the shoulder of element two to lock them together. The third element contains a series of horizontal lines formed on its surface between the numeric scale to further refine the distance of needle exposure, in the manner a micrometer is marked. As the first and second elements are moved along the third element, a different numeral and/or horizontal line will be exposed next to the first element indicating the total amount of needle exposure.

The two Walker patents, as well as the other cited prior art patents suffer from several major defects which cause the tool to be expensive to fabricate, or are very fragile and quickly worn out, or are difficult to operate by many users who are elderly and not as adept at mastering complex assembly procedures nor are they physically able to perform the many steps required to either replace the needle or change the needle length. One objection to known embroidering tools with adjustable needle capabilities is the inconvenience involved in making the adjustments. In some cases the tool parts must be disassembled and thereafter reassembled to make an adjustment. Yet another objection is to the uncertainty in duplicating needle adjustments. In some tools there are no convenient provisions for indexing the adjustment to the depth of penetration of the needle and as such, a trial and error approach to duplicating a previous adjustment is often resorted to.

It would be a great improvement in the art to provide a punch embroidery type needle in which a damaged needle could be easily replaced or a different sized needle may be inserted without replacing any other elements and in which the mechanism for adjusting the length of the exposed portion of the needle is easy to manipulate, rapid, and consistently accurate.

SUMMARY AND OBJECTS OF THE INVENTION

According to the invention, the embroidery tool is used for punch embroidery. The invention allows convenient and precise adjustment and inexpensive needle replacement. The invention includes a barrel serving as an outer shell with a slot having adjusting notches for receiving a pin located on the outer surface of a shaft inserted into the bore. An interchangeable tip having a cannular needle pressed therein is inserted into an axial bore within the shaft. The shaft is then assembled with a spring and inserted into the bore of the barrel with the pin moved along the slot until it is engaged within the proper slot setting.

It is therefore a primary object of the invention to provide a punch embroidery tool which is simple in design, inexpensive to manufacture, effective in operation, and provides substantial improvement over the present methods.

It is a further object of the invention to provide an embroidery tool in which the mechanism for adjusting the exposed length of the needle is extremely durable, simple, easy to manipulate, and rapid and consistently precise.

A still further object of the invention is to provide an embroidery tool in which a damaged needle can be replaced or a different sized needle can be inserted without replacing any other portion of the device.

Yet another object of the invention is to provide an embroidery tool in which the adjustment device may be readily observable by the user such that the desired height of the formed loops may be more readily and easily controlled.

Still another object of the invention is to provide an embroidery tool in which the adjustment may be made without removing the needle from the material or removing the thread from the needle.

These and other objects of the invention will become apparent to those skilled in the art to which the invention pertains when taken in light of the annexed drawings.

DESCRIPTION OF THE PREFERRED EMBODIMENT

Figure 1:
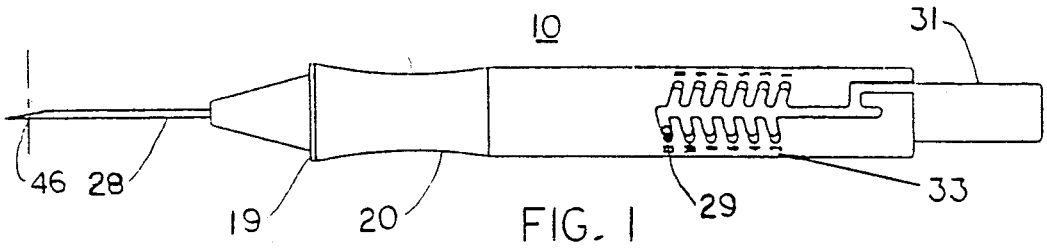
FIG. 1 is a top view of the embroidery tool.

Referring now in more detail to the drawings, the embroidery tool 10 includes a barrel 11 having a generally elongated body 12. The barrel body 12 includes a smooth wall bore 13 extending entirely therethrough so as to present openings at opposite forward and rear body ends 14 and 15 respectively. The forward end 14 of the body 12 comprises a forward tapered end portion 16 having a projecting neck or nozzle portion 17 of reduced diameter and having a passage 18 therethrough. The longitudinal bore 13 ends in a shoulder 26 within forward body end 14. The forward end 14 also comprises a radially outward directed flange 19. In that regard, the flange 19 serves to present an outwardly extending shoulder surface 20 which forms a convenient thumb and finger grasping area when the body is used to manipulate the device in the desired manner.

The body 12 is also provided with a longitudinally oriented slot 21 opening into the bore 13, starting aft of the midpoint of body 12 and running rearwardly to the rearward end 15. Longitudinal slot 21 has a plurality of aligned parallel notches 22 on each side and a retracted position notch 23 ending short of the rearward end 15. The notches 22 serve to adjustably vary the effective length of piercing portion 27 of needle 28. In a preferred embodiment, the notches 22 were arranged with six notches on each side of slot 21 with the even positions on the left side facing forward and the odd positions on the right side. The number one position provides the minimum insertion of needle 28 into the fabric and position twelve provides the maximum insertion of needle 28 into the fabric. Indicia 33 is provided on the outer face of the body 12, near each notch 22 to provide a ready indication of the extent to which the piercing portion 27 of the needle 28 projects outwardly of the body 12 within predetermined limits set by the coaction of the pin 29 and the notches 22 and 23.

The notches 22 are slanted rearwardly to provide a firm seat for pin 29 as compressed spring 30 biases the shaft 31 rearwardly. The force of preloaded spring 32 or compressed spring 30, in combination with the rearwardly slanted notches 22, is used to retain the pin 29 in engagement with each of the notches 22. In addition, the slant of the notches 22 hold the shaft 31 in each set position as the operator applies force to insert the needle 28 into the fabric. It should also be pointed out that once the position has been set as by placing pin 29 in a notch 22, that the needle 28 will thereafter not normally move longitudinally with respect to the body 12 unless readjusted. Thus the craft artisan, by merely occasionally checking the position of the pin 29, can determine that the desired maximum projection of the needle 28 and accordingly that the formed yarn loops will be in the desired range.

In a preferred embodiment, the notches 22 were spaced ⅛" apart on each side with the left side being offset 1/16" forward of the right side to provide adjustments in 1/16" increments.

A right angle slot 24, located forward of notch 23 and opening into the bore 13, runs a short distance perpendicular to slot 21 and then turns a right angle and runs the remaining distance to the rearward end 15 where an opening 25 is provided in body 12.

The diameters of the bore 13 and the shaft 31 are such that they provide a relatively close engagement therebetween which, however, permits free slidable movement unless restricted by the notches 22 as above indicated. Accordingly, wobble of the needle 28 is essentially prevented.

In a preferred embodiment, the barrel 11 was made from polycarbonate material although other materials such as other plastics or metal may be used.

Figures 2, 3:
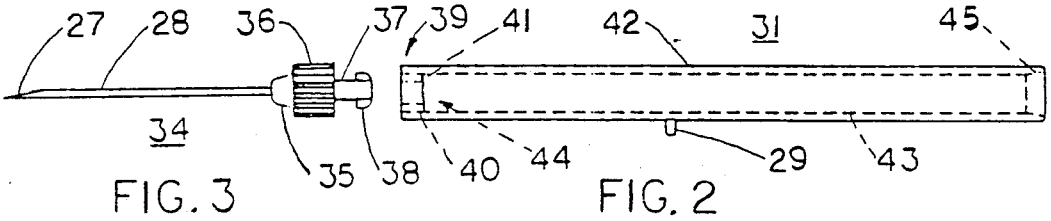
FIG. 2 is a top view of the shaft.
FIG. 3 is a top view of the interchangeable tip.
Figure 4:
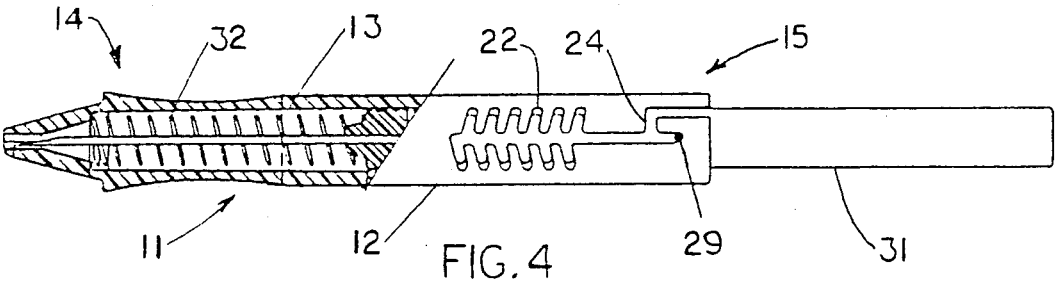
FIG. 4 is a top view, partially in section, of the needle in a retracted position.
Figure 5:
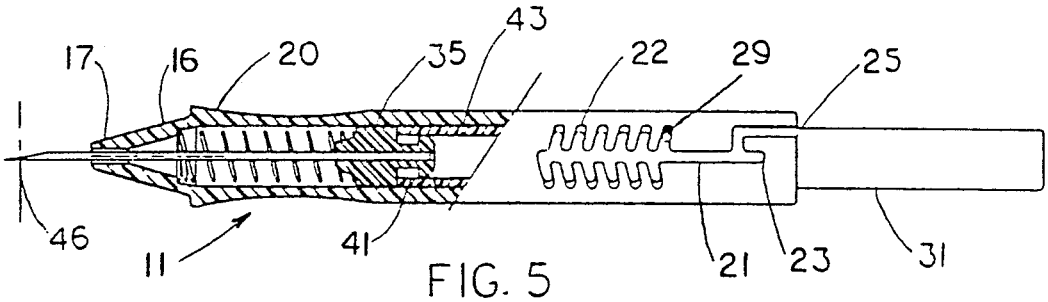
FIG. 5 is a top view, partially in section, of the needle in the first position.
Figure 6:
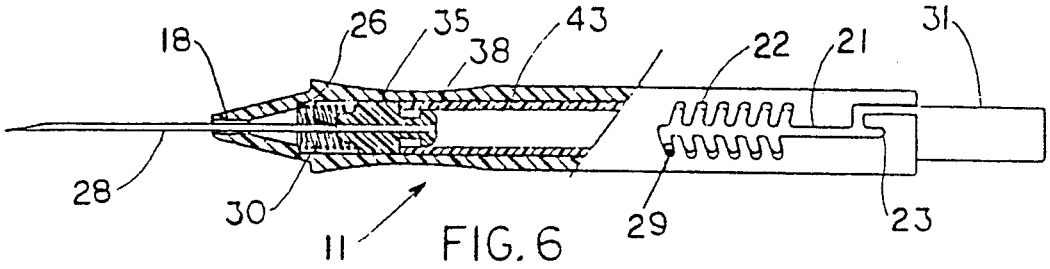
FIG. 6 is a top view, partially in section, of the needle in the twelfth position.
Figure 8:
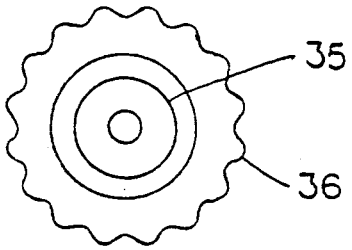
FIG. 8 is a top view of the interchangeable tip.
Figure 7:
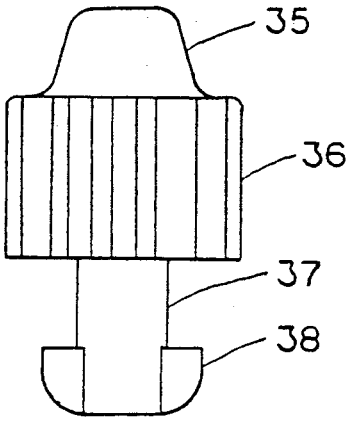
FIG. 7 is a side view of the interchangeable tip.
Figure 10:
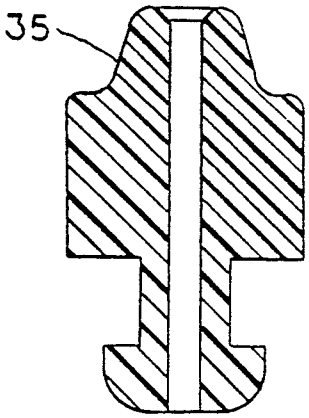
FIG. 10 is a sectional view of the interchangeable tip.
Figure 9:
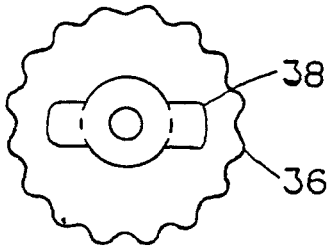
FIG. 9 is a bottom view of the interchangeable tip.
Figure 12:
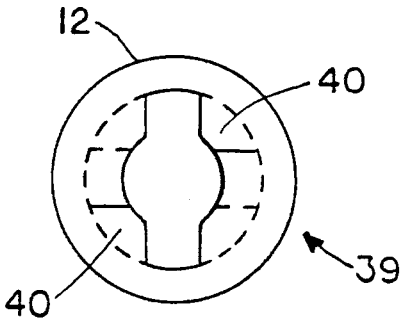
FIG. 12 is an end view of the forward end of the shaft.
Figure 11:
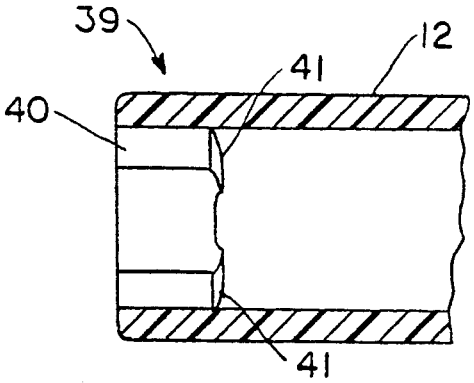
FIG. 11 is a sectional view of the forward end of the shaft.

Referring now to FIG. 3, the interchangeable needle assembly 34 shows the needle 28, force fit or glued into bore 37 of interchangeable tip 35. Ribs 36 are molded around the periphery of tip 35 to provide a non-slip surface to facilitate the assembly of tip 35 and shaft 31. Male end 37, having tabs 38, is inserted into forward end 39 of shaft 31 with tabs 38 fitting between cams 40. After the male end 37 is fully inserted, the tip 35 is twisted ¼ turn. Tabs 38 are sufficiently flexible to be deflected, "cammed out" by cam rise surfaces 41 shown in FIG. 2 and 5, and return to their normal shape when set and held between cam rise surfaces 41 on cams 40. Disassembly is performed in an opposite manner by twisting tip 35 one quarter turn.

The embroidery tool 10 includes two interfitting components or parts, barrel 11 and shaft 31. The shaft body 42 includes a smooth wall bore 43 extending entirely therethrough so as to present openings at opposite ends. Forward end 44 of the bore 43 comprises the cams 40 as described above. A pin 29 is formed on one side of the shaft body 42 to control the position of shaft 31 and the needle 28 when assembled. The rearward end 45 is chamfered to provide an unobstructed channel for the yarn or thread used for embroidery. The exterior surface of body 42 provides a smooth, frictionless mating surface for barrel 11. In a preferred embodiment, polycarbonate was used although other plastics or metals may be used.

In a preferred embodiment, spring 32 had a diameter of 0.30, with a 1.250 compression length, 0.350 maximum compressed length, overall length 1.725 and a 0.125 preload.

The embroidery tool is assembled by selecting the appropriate interchangeable needle assembly 34 and inserting it in shaft 31. The various needle sizes available are:

| NEEDLE SIZE | | |
|---|---|---|
| 17 GAUGE | (.045) | SMALL |
| 16 GAUGE | (.050) | MEDIUM |
| 14 GAUGE | (.064) | LARGE |

The needle 28 thus far described is a conventional hypodermic (cannulation) needle design, but to adapt the assembly 34 for use in the embroidery tool contemplated herein, the assembly 34 is modified by providing a hole 46 at the piercing end 27 of the needle 28. The hole 46 projects radially of the longitudinal axis of the needle 28 and communicates with the exterior of the needle 28 and also with the needle passage in the area of the inclined end surface. The hole 46 serves as the needle 28 eye through which the length of yarn or other material passes to the exterior of the tool in forming the loops during use.

Tip 35 contains an engraved letter indicating the size of needle 28 to assist craftsmen in selecting the appropriate needle size.

Spring 30 is slipped over the needle assembly 34 at the end of shaft 31 and inserted into the rearward end 15 of body bore 13 with the pin 29 guided into slot 21. Shaft 31 is pushed forward until it hits the right angle slot 24, rotated counterclockwise until the pin 29 is guided into longitudinally oriented slot 21. Pin 29 is then placed in the appropriate notch 22 for the length of loop required, or pin 29 may be placed in retracted position notch 23 if desired.

Punch embroidery can be worked on almost any type of fabric. Any yarn or thread that will flow freely through the needle is acceptable. Threading the needle is done in two steps. First, the needle is threaded then the eye of the needle is threaded. A needle threader is inserted into the open end of the needle 28 and pushed all the way through the shaft 31. The yarn is laced through the threader and the threader is pulled all the way back until the yarn comes through the tip of the needle and the threader is free. Remove the yarn from the threader and insert the threader through the hole 46 from back to front. Lace the yarn through the threader and pull the threader back until the yarn comes through the hole 46 and the threader is free. Remove the yarn from the threader and the eye of the needle is now threaded and ready to punch. The embroidery tool 10 is held like a pencil with the open side facing out from the palm of the hand towards the unfinished area. The needle 28 is then inserted as far as it will go, withdrawn to the surface, slid one needle width and reinserted. The process is continued until the design is completed.

To obtain a contoured, three dimensional effect, the length of the exposed needle 28 is changed by moving the pin 29 to the desired position. The needle 28 does not have to be removed from the fabric to set the length of the exposed needle 28. The twelve positions available permit rapid and precise changes in the length of the loops.

While the invention has been explained with respect to a preferred embodiment thereof, it is contemplated that various changes may be made in the invention without departing from the spirit and scope thereof.

What is claimed is:

1. An embroidery tool comprising:

elongated body means having;

a forward end, a midpoint and a rearward end, a smooth wall bore extending axially therethrough, a longitudinally oriented first slot opening into said bore, said first slot starting aft of said midpoint of said body and running towards said rearward end and ending in a retracted notch, a plurality of aligned parallel notches on each side of said slot, a second slot having an opening starting at said first slot rearward of said notches, and opening into said bore starting forward of said retracted notch and perpendicular to said first slot, and having a back end, a third slot opening into said bore starting at said back end of said second slot and longitudinally oriented parallel to said first slot and ending at said rearward end, a shaft, having a forward end a midpoint, a rearward end, and an outer surface slideably engaged within said bore in said elongated body, and having;

a bore extending axially therethrough, guide means on said outer surface of said shaft forward of said midpoint of said shaft for guiding said shaft in said slots and notches, and cam means formed in said bore at said forward end, an interchangeable assembly having;

a needle, and a tip having a pair of tabs for engaging said cam means when mated within said shaft bore, and compression means assembled over said needle for yieldingly urging said needle assembly and shaft in a rearwardly direction for maintaining said guide means in each selected position.

2. An embroidery tool as claimed in claim 1 wherein said notches are angled rearwardly, six on each side of said slot and spaced one eight inch apart from each other, with the left side being offset one sixteenth inch forwardly of the right side for providing adjustments in one sixteenth inch increments.

3. An embroidery tool as claimed in claim 1 wherein said guide means comprises pin molded on said outer surface.

4. An embroidery tool comprising:

elongated body means having;

a forward end, a midpoint and a rearward end, a smooth wall bore extending axially therethrough, a longitudinally oriented first slot opening into said bore, said first slot starting aft of said midpoint of said body and running towards said rearward end and ending in a retracted notch, a plurality of aligned parallel notches on each side of said slot, a second slot having an opening starting at said first slot rearward of said notches, and opening into said bore starting forward of said retracted notch and perpendicular to said first slot, and having a back end, a third slot opening into said bore starting at said back end of said second slot and longitudinally oriented parallel to said first slot and ending at said rearward end, a shaft, having a forward end, a midpoint, a rearward end, and an outer surface slideable engaged within said bore in said elongated body, and having;

a bore extending axially therethrough, a pin formed on said outer surface of said shaft forward of said midpoint of said shaft for guiding said shaft in said slots and notches, and two pairs of cam surfaces in opposed relationship to each other formed in said bore at said forward end, an interchangeable assembly having;

a needle, and a tip having a pair of tabs for engaging said cam surfaces when mated within said shaft bore, and a compression spring assembled over said needle for yieldingly urging said needle assembly and shaft in a rearwardly direction for maintaining said pin in each selected position.

* * * * *